US010287868B2

(12) United States Patent
Walters et al.

(10) Patent No.: US 10,287,868 B2
(45) Date of Patent: May 14, 2019

(54) IGNITING UNDERGROUND ENERGY SOURCES USING PROPELLANT TORCH

(71) Applicant: Halliburton Energy Services, Inc., Houston, TX (US)

(72) Inventors: Darren Phillip Walters, Tomball, TX (US); Kevin Scott Harive, Houston, TX (US); Thomas Earl Burky, Mansfield, TX (US); Christopher Thaddeous Linsky, Marlow, OK (US); Iosif Hriscu, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 170 days.

(21) Appl. No.: 15/039,800

(22) PCT Filed: Nov. 30, 2015

(86) PCT No.: PCT/US2015/063018

§ 371 (c)(1),
(2) Date: May 26, 2016

(87) PCT Pub. No.: WO2016/204806

PCT Pub. Date: Dec. 22, 2016

(65) Prior Publication Data

US 2017/0198562 A1 Jul. 13, 2017

Related U.S. Application Data

(60) Provisional application No. 62/198,963, filed on Jul. 30, 2015, provisional application No. 62/175,859, filed on Jun. 15, 2015.

(51) Int. Cl.

| | |
|---|---|
| ***E21B 43/295*** | (2006.01) |
| ***E21B 43/243*** | (2006.01) |
| ***E21B 36/00*** | (2006.01) |

(52) U.S. Cl.
CPC ..... *E21B 43/295* (2013.01); *E21B 36/008* (2013.01); *E21B 43/243* (2013.01)

(58) Field of Classification Search
CPC ..... E21B 43/295
(Continued)

(56) References Cited

U.S. PATENT DOCUMENTS

| | | | |
|---|---|---|---|
| 4,499,945 | A | 2/1985 | Hill et al. |
| 4,705,109 | A | 11/1987 | Ledent et al. |

(Continued)

FOREIGN PATENT DOCUMENTS

| | | |
|---|---|---|
| CA | 840515 | 4/1970 |
| GB | 2486613 | 8/2012 |

(Continued)

OTHER PUBLICATIONS

International Search Report and Written Opinion for International Application No. PCT/US2015/063018 dated Mar. 15, 2016.

*Primary Examiner* — Zakiya W Bates
*Assistant Examiner* — Ashish K Varma
(74) *Attorney, Agent, or Firm* — Alan Bryson; C. Tumey Law Group PLLC

(57) ABSTRACT

A system and a method for underground gasification comprising a downhole ignition device. The downhole ignition device may comprise a connection housing at a first end of the downhole ignition device. The connection housing may comprise an igniter and a first fire mix. The downhole ignition device may further comprise a body coupled to the connection housing. The body may comprise pyrotechnic modules arranged in series and additional first fire mix. A cap may be disposed at a second end of the connection housing. Additionally, the downhole ignition device may comprise a supply line and a recovery system. A method for igniting an underground energy source may comprise posi-
(Continued)

tioning a downhole ignition device adjacent an underground energy source in a wellbore, igniting a first fire mix in the downhole ignition device, and igniting a series of pyrotechnic modules arranged in the downhole ignition device.

19 Claims, 7 Drawing Sheets

(58) Field of Classification Search
USPC ..... 166/256
See application file for complete search history.

(56) References Cited

U.S. PATENT DOCUMENTS

| | | | | |
|---|---|---|---|---|
| 2003/0132224 | A1* | 7/2003 | Spencer | E21B 33/13 219/635 |
| 2012/0055666 | A1* | 3/2012 | Swor | E21B 23/06 166/58 |
| 2013/0312950 | A1 | 11/2013 | Shaikh et al. | |
| 2014/0134057 | A1 | 5/2014 | Peters | |
| 2015/0041125 | A1 | 2/2015 | Perkins et al. | |

FOREIGN PATENT DOCUMENTS

| | | |
|---|---|---|
| WO | 2012109711 | 8/2012 |
| WO | 2014085855 | 6/2014 |
| WO | 2014089603 | 6/2014 |

* cited by examiner

IGNITING UNDERGROUND ENERGY SOURCES USING PROPELLANT TORCH

CROSS REFERENCE TO RELATED APPLICATIONS

The present application is a 371 national phase entry of International Application No. PCT/US2015/063018, filed Nov. 30, 2015, which claims priority to U.S. Provisional Application No. 62/198,963, filed Jul. 30, 2015, and U.S. Provisional Application No. 62/175,859, filed Jun. 15, 2015, the entirety of these disclosures are incorporated herein by reference.

BACKGROUND

The present disclosure relates to systems and methods for underground gasification.

Underground gasification may be an alternative method of extracting energy from an underground energy source. The method may involve drilling one or more wells into an underground energy source and igniting the underground energy source. Typically, the wells may be connected within the underground energy source to form a horizontal well. The underground energy source may be ignited to produce synthetic gas, "syngas", which may flow or be pumped out of a recovery well, connected to the underground energy source.

The ignition and re-ignition of an underground energy source may often be unreliable. Current methods of ignition may include the use of (1) pyrophoric gases, (2) chemical reactants, or (3) electrical glow plugs or resistors. The use of pyrophoric gases and chemical reactants may present safety and environmental hazards, leading to the risk of increased injuries and increased risk-mitigation costs. Additionally, current technology in igniting an underground energy source may often be impractical and not cost effective. Thus, there is needed a more cost effective and reliable system and method for the ignition and re-ignition of an underground energy source.

BRIEF DESCRIPTION OF THE DRAWINGS

These drawings illustrate certain aspects of some of the examples of the present invention, and should not be used to limit or define the invention.

DETAILED DESCRIPTION

Figure 1:
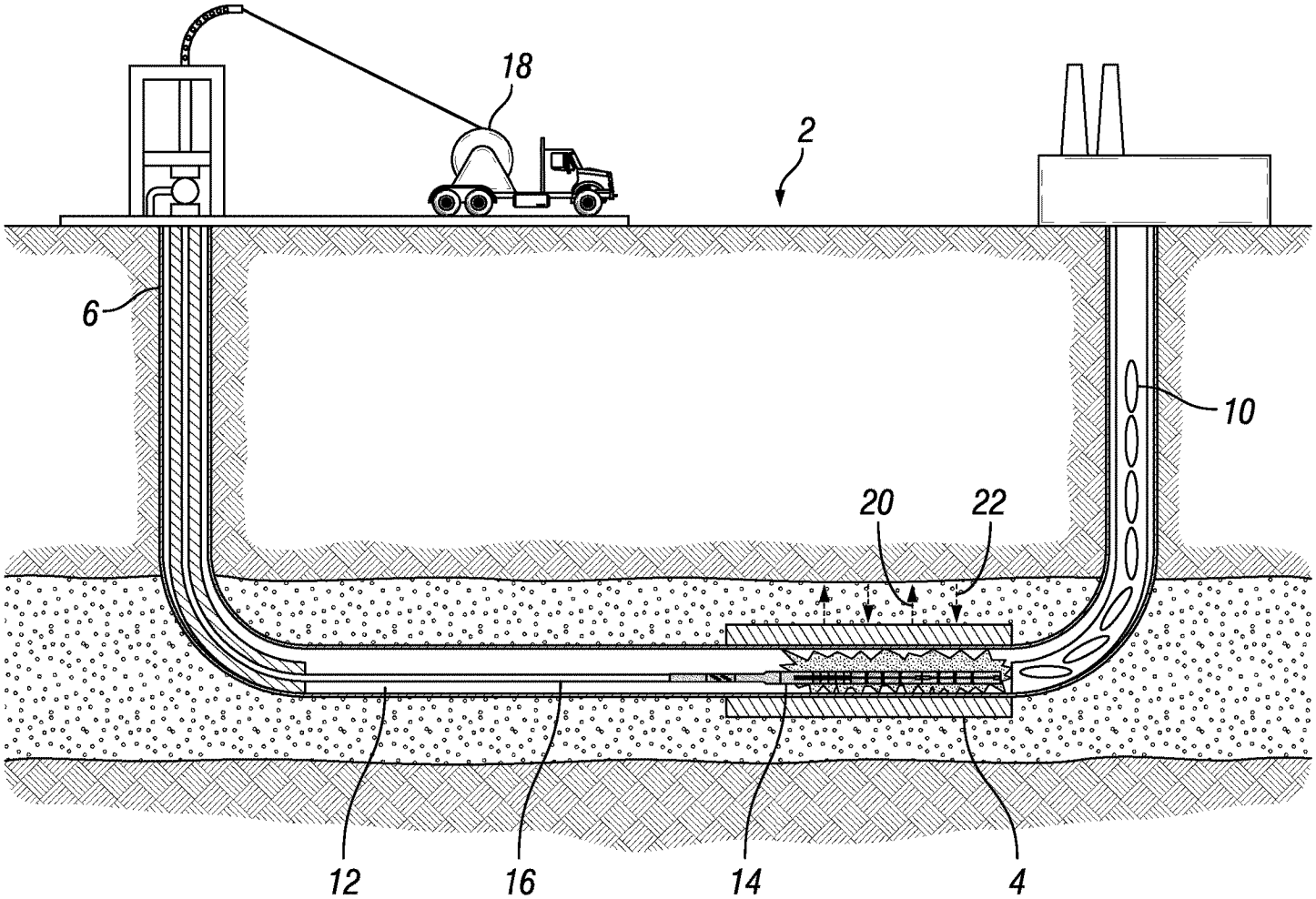
FIG. 1 is an example of an underground gasification system.

The present disclosure relates to a system and method for initiating and monitoring an underground gasification process. This disclosure may also describe use of a propellant torch to ignite an underground energy source.

Underground gasification may be a process used to create synthetic gas by igniting an underground energy source. Typically, one or more wells may be drilled into an underground energy source. Without limitation, two or more wells may be drilled, wherein each well may be connected within the underground energy source, for example, to create a horizontal well. One or more wells may be used as an injection well, and one or more wells may be used as a recovery well. The injection and recovery wells may be on the same or different sides of the underground energy source.

A downhole ignition device may be inserted into the injection well and may ignite the underground energy source. Once the underground energy source is ignited, a synthetic gas, "syngas," may be produced as the underground energy source burns. Syngas may include, but is not limited to, methane, hydrogen, carbon monoxide, carbon dioxide, water vapor, air, and/or oxygen. This gas may flow or may be pumped out through a recovery well. The downhole ignition device may typically be removed from the burning underground energy source to a location in the injection well (or at the surface) and may be utilized within the horizontal well or injection well. Additionally, the underground energy source may require re-ignition. To re-ignite the underground energy source, the downhole ignition device may be sent downhole and disposed adjacent the underground energy source. The ignition process, described above, may be repeated in an effort to re-ignite the underground energy source.

The downhole ignition device may also record and transmit bottombole conditions such as pressure, temperature, and humidity through a communication line. These recordings may be transmitted to the ground surface in real time to control the gasification process. Temperature sensors may be used to determine when the underground energy source is sufficiently burning, allowing for removal of the downhole ignition device from the well. Water or steam may be used during underground gasification to control air temperatures within the burning underground energy source. Additionally, the downhole ignition device may detect, measure, and/or transmit data regarding gases disposed in the underground energy source, including, but not limited to, methane, hydrogen, carbon monoxide, carbon dioxide, water vapor, air, and/or oxygen. The downhole ignition device may also utilize a casing collar locator or a Gamma sensor for accurate placement of the downhole ignition device in the underground energy source for maximum efficiency.

Accordingly, this disclosure describes devices, systems, and methods which may be used to ignite underground energy sources with a downhole ignition device. A downhole ignition device may comprise a connection housing which may comprise an igniter and a first fire mix. A body may be coupled to the connection housing, where the body may comprise pyrotechnic modules and additional first fire mix. The body may further comprise plugs that may fill holes in the body, where the pellets may be configured to burn through the plugs, which may be comprised of a eutectic material. In examples, the downhole ignition device may further comprise a cap that may be disposed at an end of the downhole ignition device opposite the connection housing. The body may further comprises a sleeve that may hold one or more of the pyrotechnic modules in place. The pyrotechnic modules may be arranged in series and may comprise a main load and pellets that may extend into the main load. The connection housing may further comprises an injection port for supplying an accelerant to the downhole ignition device. The body may connect to a second body, which may comprise additional pyrotechnic modules arranged in series.

An underground gasification system for igniting an underground energy source may comprise a downhole ignition device. The downhole ignition device may comprise a connection housing which may further may comprise an igniter and a first fire mix. A body may be coupled to the connection housing, where the body may comprise pyrotechnic modules arranged in series and an additional first fire mix. A supply line may position the downhole ignition device adjacent an underground energy source. The underground gasification system may further comprise a recovery system. The body may further comprise a sleeve that may hold one or more of the pyrotechnic modules in place. The pyrotechnic modules may be arranged in series and comprise a main load and pellets that may extend into the main load. The underground gasification system may further comprise a cap disposed at an end of the downhole ignition device opposite the connection housing. The body may further comprise plugs that may fill holes in the body, where the pellets may be configured to burn through the plugs. The plugs may comprise a eutectic material. The connection housing may further comprise an injection port for supplying an accelerant to the downhole ignition device. The body may connect to a second body, where the second body may comprise additional pyrotechnic modules arranged in series. An injection well and a recovery well may be connected with the underground energy source, where the supply line may extend through the injection well to position the downhole ignition device adjacent to the underground energy source.

A method for igniting an underground energy source may comprise positioning a downhole ignition device adjacent an underground energy source in a wellbore, igniting a first fire mix in the downhole ignition device, and igniting a series of pyrotechnic modules arranged in the downhole ignition device with the first fire mix such that a downhole energy source is ignited. The downhole ignition device may comprise a connection housing at a first end of the downhole ignition device, where the connection housing may comprise an igniter and a first fire mix. The downhole ignition device may further comprise a body coupled to the connection housing, where the body may comprise pyrotechnic modules arranged in series and additional first fire mix. A cap may be disposed at a second end of the connection housing. The first fire mix may be disposed within a pyrotechnic module and the first fire mix and the pyrotechnic module may traverse the length of the body. The body may further comprise a sleeve that may hold one or more of the pyrotechnic modules in place. The pyrotechnic modules may comprise a main load and pellets that may extend into the main load. The body may further comprise plugs that may fill holes in the body, where the method may further comprise pellets burning through the plugs. The plugs may comprise a eutectic material. The method may further comprise transmitting accelerant to the downhole injection device through one or more injections ports in the connection housing. Additionally, the first fire mix may be disposed partially in the body. The method may also comprise withdrawing the downhole ignition device from the underground energy source and the wellbore with a recovery system, positioning a second downhole ignition device adjacent the underground energy source in the wellbore, and igniting the second downhole ignition device.

FIG. 1 illustrates an example of an underground gasification system 2, which may be used to extract gas, energy, and/or the like from an underground energy source 4. An injection well 6 may be drilled from the surface 8 into underground energy source 4 and may be used to inject tools, gases, and/or the like into the ground and/or underground energy source 4. A recovery well 10 may be drilled from the surface into underground energy source 4 and may allow for the recovery of gas produced during gasification. Horizontal well 12 may be drilled along underground energy source 4 in the direction of the desired gasification and may connect injection well 6 and recovery well 10. Injection well 6, horizontal well 12, and/or recovery well 10 may be lined with a casing or multiple casings. While injection well 6 and recovery well 10 are shown on opposite sides of underground energy source 4, it should be understood that their placement on FIG. 1 is non-limiting and injection well 6 and recovery well 10 may be placed on the same or different sides of underground energy source 4, as may be desired for a particular application. Underground energy source 4 may comprise coal and/or other sources of energy.

Underground gasification system 2 may include downhole ignition device 14 that may be used to ignite underground energy source 4 and collect data that may be transmitted to the surface 8. As illustrated in FIG. 1, downhole ignition device 14 may be lowered into injection well 6 using supply line 16. Supply line 16 may comprise coiled tubing, wireline, and/or the like, and may also attach to a recovery system 18. Recovery system 18 may comprise a reel with supply line 16 and may have the capacity to hold and/or recover any length of supply line 16. During underground gasification, underground energy source 4 may burn as illustrated in FIG. 1. Gasification may produce heat and hot gases 20. Water influx 22 may control underground gasification, which may dispose water into and/or near underground energy source 4. Water influx 22 may control temperatures during gasification, which may allow for more efficient ignition of underground energy source 4 and gasification generally. Alternatively, water and/or steam may be supplied from the surface.

Figure 2:
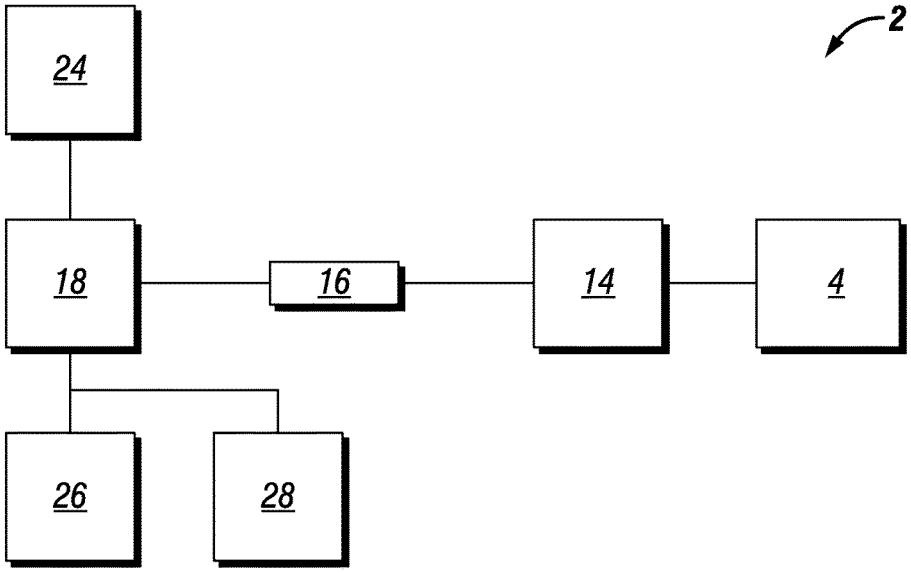
FIG. 2 is an example schematic of an underground gasification system.

FIG. 2 illustrates an example of a schematic of an underground gasification system 2. In FIG. 2, downhole ignition device 14 may be connected to supply line 16, which may be connected to recovery system 18. Supply line 16 may contain, but is not limited to, accelerant 24, power line 26, and/or communication line 28. Additionally, power line 26 and communication line 28 may be combined into a single line or may comprise several lines. Accelerant 24 may comprise oxygen, air, nitrogen dioxide, combinations thereof, and/or the like. Power line 26 may comprise an electrical line and/or a similar power source, and may provide power to various components within downhole ignition device 14, including, but not limited to, electrical sensors, the igniter mechanism, valve systems, and pumps. In examples, an electrical line, an "e-Line", may be disposed within supply line 16. E-Line may comprise a wire-wrapped electrical conduit, which may be capable of transporting 250 volts using alternating current at 0.5 amps. Additionally, e-Line may be capable of powering, controlling, sending and/or receiving data between downhole ignition device 14 and the surface 8 (e.g., shown on FIG. 2). Communication line 28 may transmit data collected at or near downhole ignition device 14 to the surface 8, may transmit signals from the surface to downhole ignition device 14, and/or may transmit signals to other systems as required. Communication line 28 may comprise a fiber optic cable, electrical cable, and/or the like. Additionally, communication line 28 may be used to activate and de-activate downhole ignition device 14, which in turn may ignite underground energy source 4.

Figure 3:
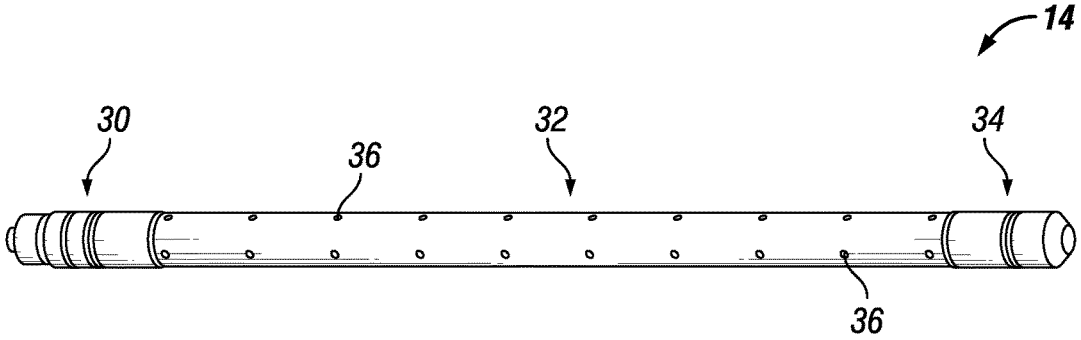
FIG. 3 is an example of a downhole ignition device.

FIG. 3 illustrates an example downhole ignition device 14 which may comprise a body 32, a connection housing 30, and a cap 34. In examples, body 32 may connect to connection housing 30 and cap 34 by any suitable means. Suitable means may be, but are not limited to, threading, press fitting, nuts and bolts, screws, adhesive, and/or any combination thereof. Body 32, connection housing 30, and cap 34 may comprise any suitable material, including but not limited to, aluminum, aluminum alloys, brass, brass alloys, magnesium, magnesium alloy, steel, steel alloy, and the like. As illustrated, connection housing 30 may be disposed at one end of body 32 and cap 34 may be disposed at the opposite end of body 32. Body 32 may further comprise plugs 36. Plugs 36 may be used to fill holes within body 32. Without limitation, plugs 36 may comprise eutectic material, low pressure caps, and/or the like, which may have characteristics of a low melting points and/or easily blown out of body 32. Plugs 36 may prevent debris from moving into body 32 and keep material from falling out of body 32. During operation, the material within body 32 may burn away and/or blow out plugs 36.

Figure 4:
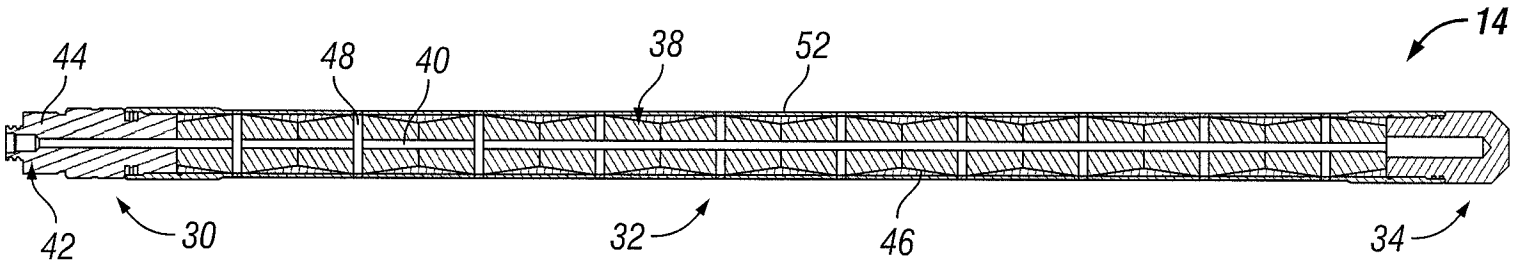
FIG. 4 is an interior view of the downhole ignition device in FIG. 3.

Referring now to FIG. 4, the example downhole ignition device 14 of FIG. 3 is illustrated in more detail. As illustrated, body 32 may house and protect pyrotechnic modules 38, a first fire mix 40, an igniter 42, and a control circuit 44. Without limitation, body 32 may have a diameter of about two inches to about four inches, about four inches to about ten inches, about six inches to about twelve inches, or about four inches to about eight inches. Additionally, body 32 may have a length of about twenty five feet to about forty feet, about fifteen feet to about thirty five feet, about twenty feet to about forty feet, or about thirty feet to about forty feet. Additionally, there may be a plurality of bodies 32, which may attach to each other to extend the length of downhole ignition device 14 and in turn the burning time of underground gasification system 2.

Figure 6:
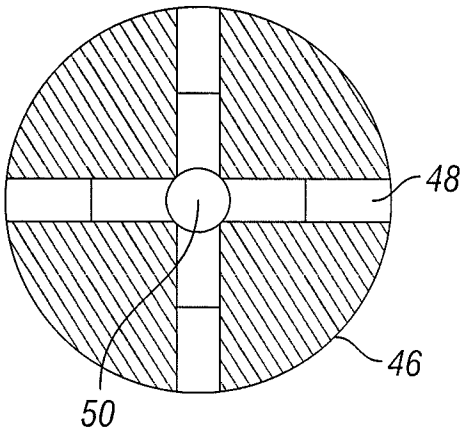
FIG. 6 is a cut away view of a module.
Figure 5:
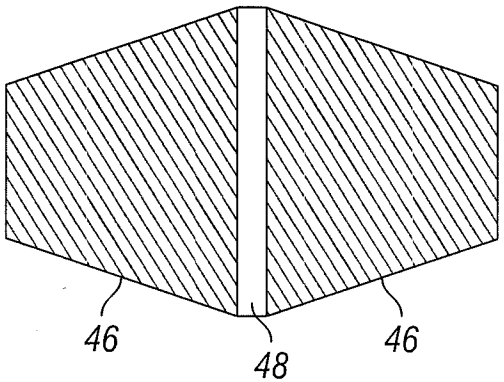
FIG. 5 is a cross section view of a module.

As illustrated, body 32 may hold any number of pyrotechnic modules 38. Pyrotechnic modules 38 may supply a substantial amount of the energy to ignite an underground energy source 4 for underground gasification system 2. With additional reference to FIGS. 5 and 6, pyrotechnic modules 38 may comprise a main load 46 and pellets 48. As illustrated, pellets 48 may be radially arranged around a channel 50 in pyrotechnic modules 38. Pellets 48 may extend from the channel 50 and into main load 46. As will be discussed in more detail below, first fire mix 40 may be disposed in channel 50. As best seen on FIG. 5, pellets 48 may be disposed between two main loads 46. Pellets 48 may comprise the same material as first fire mix 40, where first fire mix 40 may comprise, for example, compositions of magnesium with a gas generating binder. In operations, pellets 48 may be ignited by first fire mix 40. Pellets 48 may then ignite main loads 46. Additionally, pellets 48 may burn through plugs 36 (e.g., shown on FIG. 3) in body 32. Plugs 36 may quickly melt once pellets 48 are ignited, which may allow for pellets 48 and main loads 46 to burn into underground energy source 4. Additionally, removal of plugs 36 may allow for dry air and/or dry steam to reach pyrotechnic modules 38, maintaining the burning of pyrotechnic modules 38.

Figure 7A:
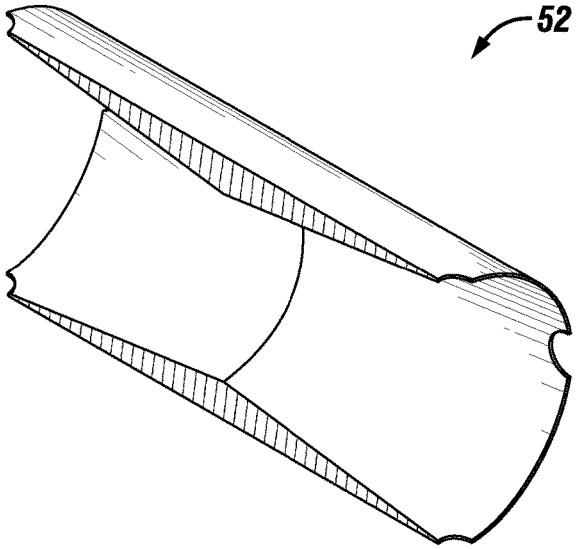
FIG. 7*a* is an example of a sleeve.
Figure 7B:
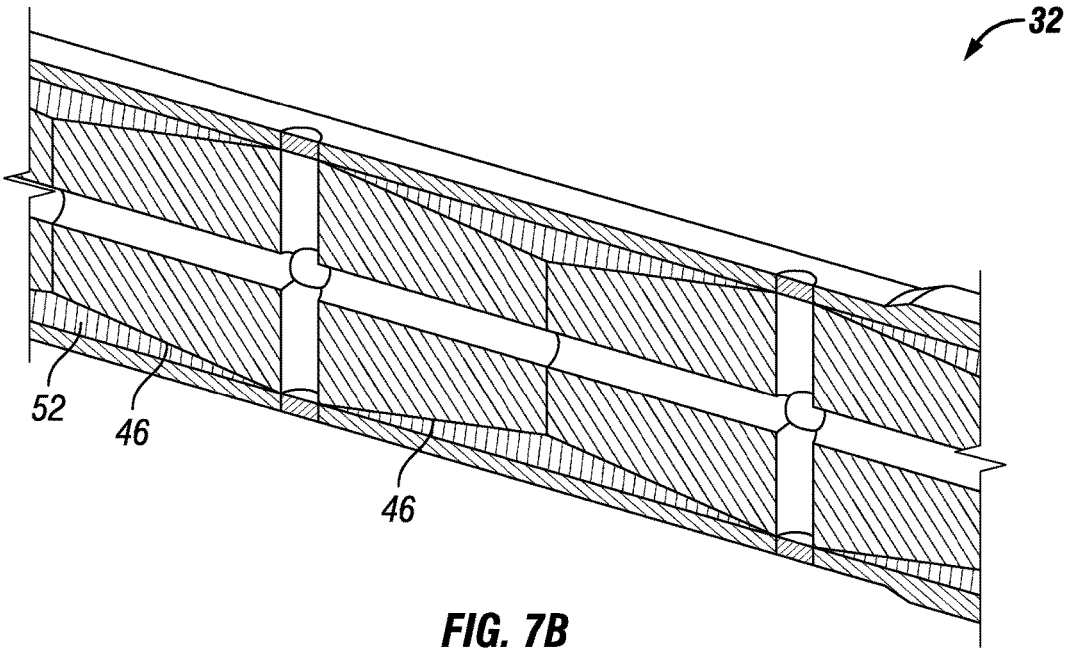
FIG. 7*b* is an example the sleeve in FIG. 7*a* within the downhole ignition device.

Pyrotechnic modules 38 may further comprise sleeves 52. As illustrated in FIGS. 7*a* and 7*b*, main loads 46 may be held in place by sleeves 52. Sleeves 52 may comprise any of a variety of suitable materials including, but not limited to, a ceramic insulation material. In examples, sleeves 52 may be overlap two main loads 46, which may hold main loads 46 in place. Additionally, sleeves 52 may trap heat within body 32, which may help in the burning of main loads 46.

Main loads 46 may be comprise any of a variety of suitable pyrotechnic materials capable of generating heat and pressure at a duration sufficient to ignite the underground energy source 4. Examples of suitable pyrotechnic materials may include combustible metals, such as magnesium, aluminum, zinc, bismuth, and combinations thereof. Alloys of combustible metals may also be suitable. The main loads 46 may further comprise an oxidizer. Examples of suitable oxidizers may include, without limitation, perchlorates, nitrates, and transitional metal oxides. Examples of suitable main loads may include mixtures of a combustible metal and an oxidizer, commonly referred to as "thermite." Polytetrafluoroethylene (e.g., Teflon® material) may further be included in the main loads 46 in combination with a combustible metal and an optional oxidizer. The pyrotechnic materials may produce an exothermic reaction, which may allow main loads 46 to burn at a very hot and slow rate. Additionally, pellets 48 may comprise magnesium compositions (or other suitable combustible metals) with a gas generating binder, which may allow pellets 48 to burn at a speed of one inch per second, for example. It may be desired for the area of main load 46 adjacent pellets 48 to have a lower density then the area of main load 46 furthest away from pellets 48. Lower density of material may allow for main loads 46 to ignite easier as pellets 48 burn. A higher density of material may burn slower and hotter than a lower density of material. A slower and hotter burn may increase the chances of igniting underground energy source 4. In examples, main loads 46 may be disposed in series in body 32, extending from connection housing 30 to cap 34. Ignition of main loads 46 from first fire mix 40 may begin within connection housing 30.

Additional materials (not illustrated), such as water-reactive chemicals may be incorporated into the downhole ignition device 14. In examples, water-reactive chemicals may be disposed adjacent plugs 36, which may allow the water-reactive chemicals to be ejected into underground energy source 4 as pellets 48 or main loads 46 are ignited. Water-reactive chemicals may be used as appropriate to enable the downhole ignition device 14 to address damp conditions which may be present in the underground energy source 4 and/or to provide additional ignition sources to react with injected steam. Examples of suitable water-reactive chemicals may include, but are not limited to, alkali metals such as Li/Na/K/as well as their hydrides such as calcium hydride or lithium hydride, metallic phosphides such as calcium phosphide or magnesium aluminum phosphide, and metallic peroxide-fuel mixtures such as aluminum iodide and sodium peroxide.

Connection housing 30 may connect body 32 to supply line 16 (e.g., shown on FIG. 1). Connection housing 30 may connect to supply line 16 by any suitable means. Suitable means may be, but are not limited to, threading, nuts and bolts, screws, press fitting, adhesive, and/or any combination thereof. As illustrated, connection housing 30 may comprise a first fire mix 40, igniter 42, and a control circuit 44. Control circuit 44 may extend from connection housing 30 and through supply line 16 to connect to a recovery system 18 (e.g., shown on FIG. 1). Control circuit 44 may be used to ignite first fire mix 40 within connection housing 30. In examples, an electrical signal may be sent through control circuit 44 to connection housing 30. The electrical signal may activate igniter 42, which may ignite first fire mix 40. In example, the electrical signal may be converted into a mechanical signal, thermal signal, and/or chemical signal within igniter 42 to ignite first fire mix 40. Igniter 42, may include, but is not limited to, a rig environment detonator igniter, A160s, industry standard resistor detonators, hotwire igniters, exploding bridgewire igniters, exploding foil initiator igniters, conductive mix igniters, percussion actuated igniters, and a HTI. First fire mix 40 may comprise compressed magnesium flare pellets and/or pellets of other suitable combustible metal which may be stacked through connection housing 30 and used to ignite pyrotechnic modules 38 within body 32. Other examples of first fire mixtures may include titanium powder with an oxidizer such as a nitrate or perchlorate. Without limitation, magnesium flare pellets may further comprise sodium nitrate and magnesium. Once ignited, first fire mix 40 may burn through connection housing 30 to ignite additional first fire mix 40 within body 32. First fire mix 40 may be disposed through each pyrotechnic module 38, which may allow first fire mix 40 to ignite each pyrotechnic module 38 within body 32. In examples, first fire mix 40 may be disposed at the center of body 32, which may allow downhole ignition device 14 to burn from inside out. In other examples, body 32 may comprise first fire mix 40, which may allow body 32 to burn from the outside in. In such an example, first fire mix 40 may further comprise a hardened binder such as a polyurethane. First fire mix 40 may include any of a variety of pyrotechnic materials, including, but not limited to, combustible metals, such as magnesium, aluminum, zinc, bismuth, or alloys of combustible metals. Other examples may include titanium powder with an oxidizer such as a nitrate or perchlorate. The ignition of first fire mix 40 may be maintained with a built in fuel/oxygen supply of first fire mix 40. This may be accomplished, for example, by further including an oxidizer in the first fire mix 40. Examples of suitable oxidizers may include, without limitation, perchlorates, nitrates, and transitional metal oxides. An example of a suitable first fire mix 40 may include sodium nitrate and magnesium. The sodium nitrate and magnesium may chemically react and act as an oxidizer while first fire mix 40 is burning. The use of an oxidizer in the first fire mix 40 may prevent the need for outside air/oxygen to maintain a combustible environment. The first fire mix 40 may increase in particle size as it extends through the downhole ignition device 14 from connection housing 30 through the body 32.

Without limitation, air and/or steam may be pumped downhole to deliver fuel/oxygen to downhole ignition device 14. Additionally, fuel/oxygen may be pumped through supply line 16 directly to downhole ignition device 14, which may aid in the ignition of first fire mix 40 and main load 46.

Figure 8:
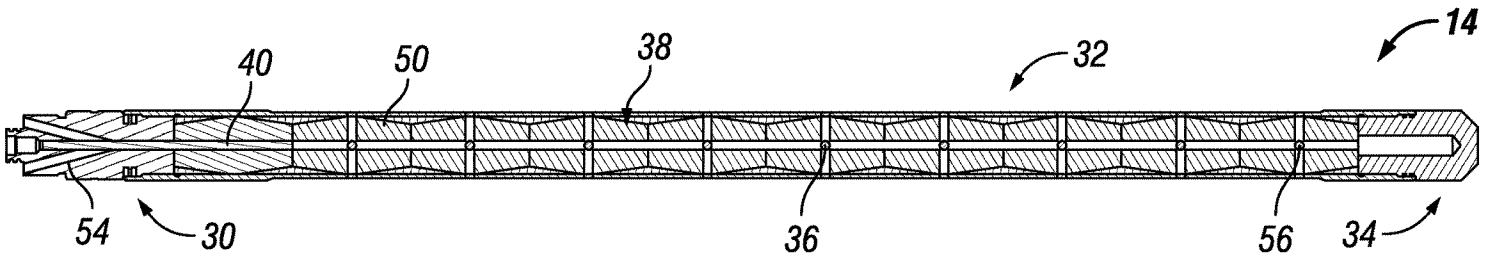
FIG. 8 is an interior view of an additional example of a downhole ignition device.
Figure 9:
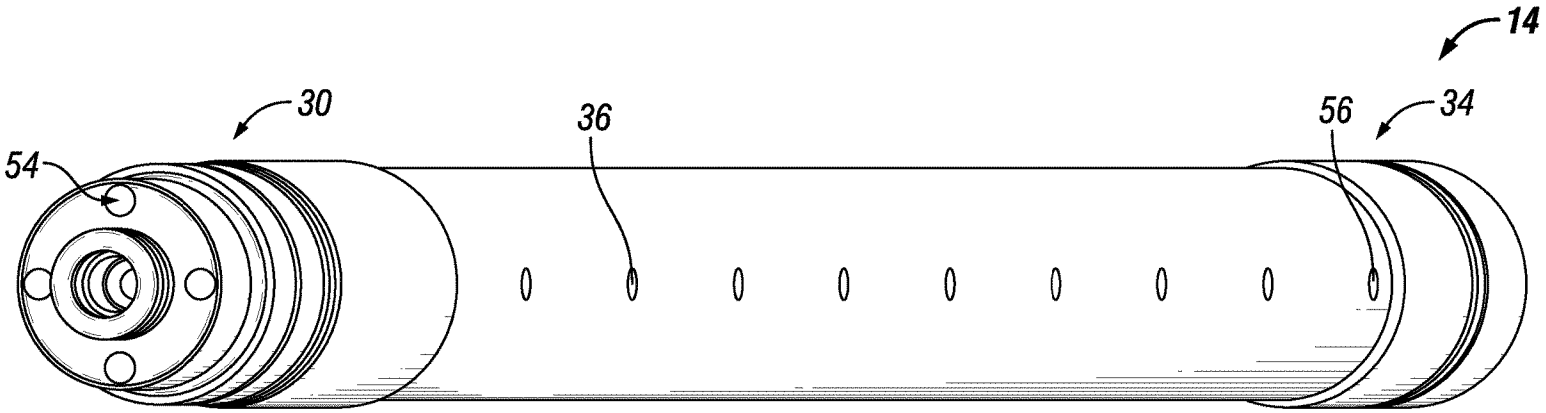
FIG. 9 is an exterior perspective of the downhole ignition device in FIG. 8.

FIGS. 8 and 9 illustrate another example of downhole ignition device 14 in which fuel/oxygen may be supplied to downhole ignition device 14 by supply line 16. As illustrated, connection housing 30 may be altered to further comprise injection ports 54. There may be any number of injection ports 54, in which fuel/oxygen may be pumped to downhole ignition device 14 through supply line 16. Additionally, low pressure plugs 56 may be disposed at the end of body 32 opposite injections ports 54, which may allow supplied fuel/oxygen to flow through connection housing 30 and through body 32. Additionally, first fire mix 40 may only traverse partially into body 32. This may allow for a channel 50 to be disposed within each pyrotechnic module 38, which may allow for fuel/oxygen to supply each burning pyrotechnic module 38. Low pressure plugs 56, may blow out and away from body 32 as fuel/oxygen is pumped through channel 50, which may allow fuel/oxygen to properly circulate within downhole ignition device 14. In examples, cap 34 may divert the flow of fuel/oxygen from channel 50 and through low pressure plugs 56.

With continued reference to FIG. 8, cap 34 may be removed as need to place pyrotechnic modules 38, pellets 48, and sleeves 52 within body 32. Pyrotechnic modules 38 may be loaded into body 32 and retained within body 32 by cap 34, which may be disposed at the end of body 32. Once body 32 is filled, cap 34 may be disposed on body 32, preventing pyrotechnic modules 38, pellets 48, and/or sleeves 52 from leaving body 32. Additionally, cap 34 may act as a buffer and help downhole ignition device 14 to maneuver within horizontal well 12 before downhole ignition device 14 is ignited. Without limitation, cap 34 may be removed and an additional body 32 may be attached, where cap 34 may be attached to the additional body 32, extending the length and amount of pyrotechnic modules 38 that are available to be burned within downhole ignition device 14.

Figure 10:
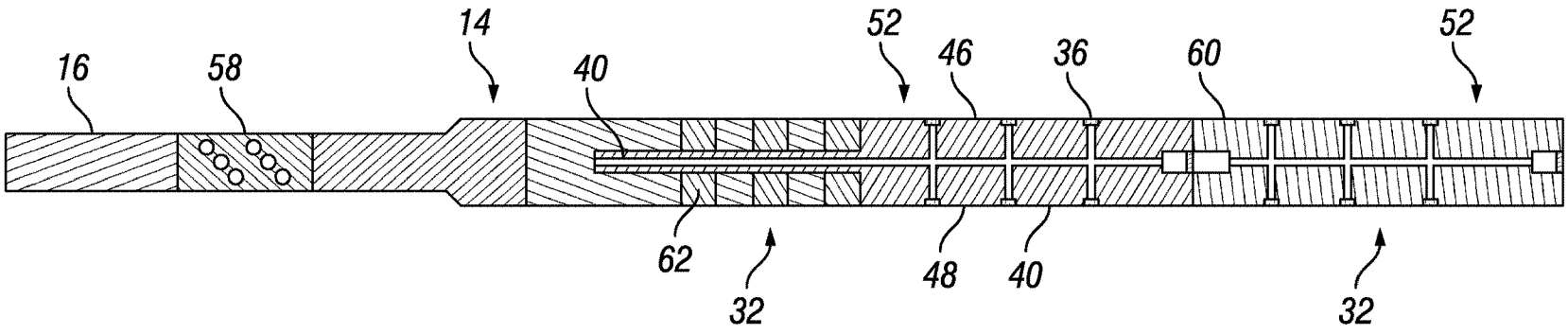
FIG. 10 is another example of a downhole ignition device.

FIG. 10 illustrates an additional example of downhole ignition device 14. As illustrated, supply line 16 connects to a vent section 58. Vent section 58 may be used to supply dry air and/or dry steam to body 32. Vent section 58 may further be connected to a connection housing 30 which may not be separated by a bulkhead 60. In operation, connection housing 30 may directly ignite first fire mix 40, wherein first fire mix 40 may ignite pellets 48, which may be used to ignite main load 46, as discussed above. Additionally, fins 62 may be connected to body 32. Fins 62 may be used to prevent body 32 from contacting the sides of injection well 6 and horizontal well 12. This may prevent body 32 from deteriorating before reaching underground energy source 4. In examples, a second body 32 may be attached to downhole ignition device 14. Additional bodies 34 may be separated by a bulkhead 60. First fire mix 40 may burn through bulkhead 60, igniting first fire mix 40 within the attached body 32.

Burning pyrotechnic modules 38 may engulf and destroy body 32. In examples, body 32 may be designed to be completely burned through, wherein recovery system 18 may not be able to retrieve body 32. This may allow for recovery system 18 to quickly remove supply line 16 while pyrotechnic modules 38 burn. The removal of supply line 16 may allow for operators to pump in dry air and/or dry steam downhole. Controlling the flow of dry air may control the burning rate of pyrotechnic modules 38 and/or the burning rate of underground energy source 4. Additionally, dry steam may further control the burning of pyrotechnic modules 38 and/or underground energy source 4 by placing water vapor into the burning areas, which may cool and control burning rates. The ability to control the burning of underground energy source 4 may allow for a more efficient removal of syngas from underground energy source 4 to the surface.

Figure 11:
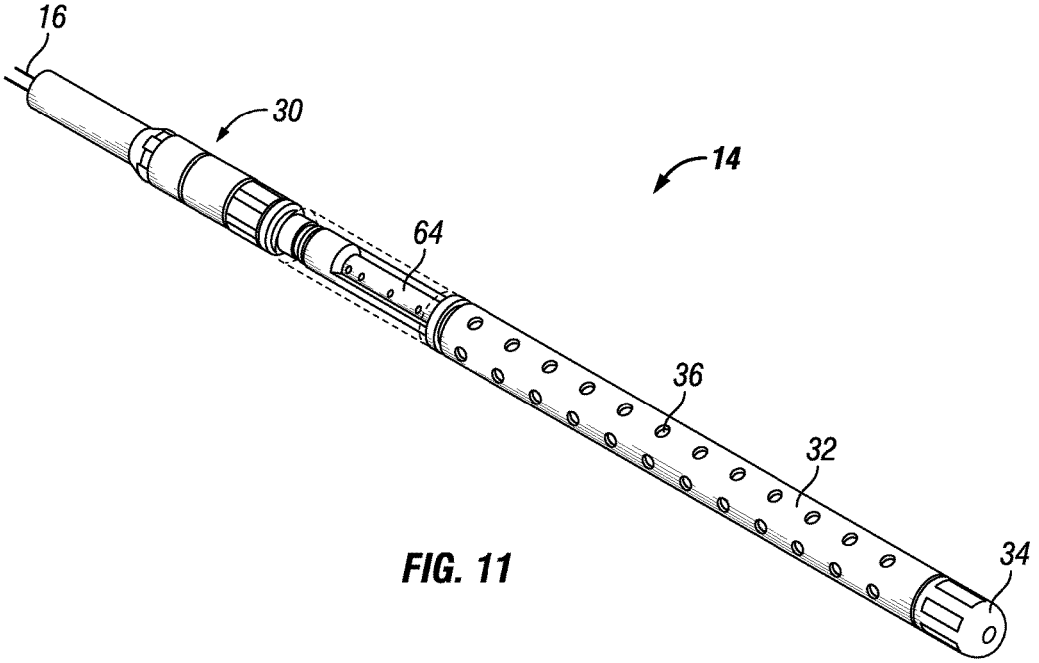
FIG. 11 is another example of a downhole ignition device.

FIG. 11 illustrates an example of supply line 16 and downhole ignition device 14. Supply line 16 may attach to downhole ignition device 14 using connection housing 30. Connection housing 30 may comprise injection ports 54 (for example, as shown in FIG. 8), igniter 42 (for example, as shown in FIG. 4), control circuit 44 (for example, as shown in FIG. 4), and/or first fire mix 40 (for example, as shown in FIG. 8). In examples, connection housing 30 may further comprise electronic sensor subassembly 64, which may include sensors that may measure temperature, pressure, humidity, and/or the like. Body 32, cap 34, and/or plugs 36 may further comprise downhole ignition device 14.

Figure 12:
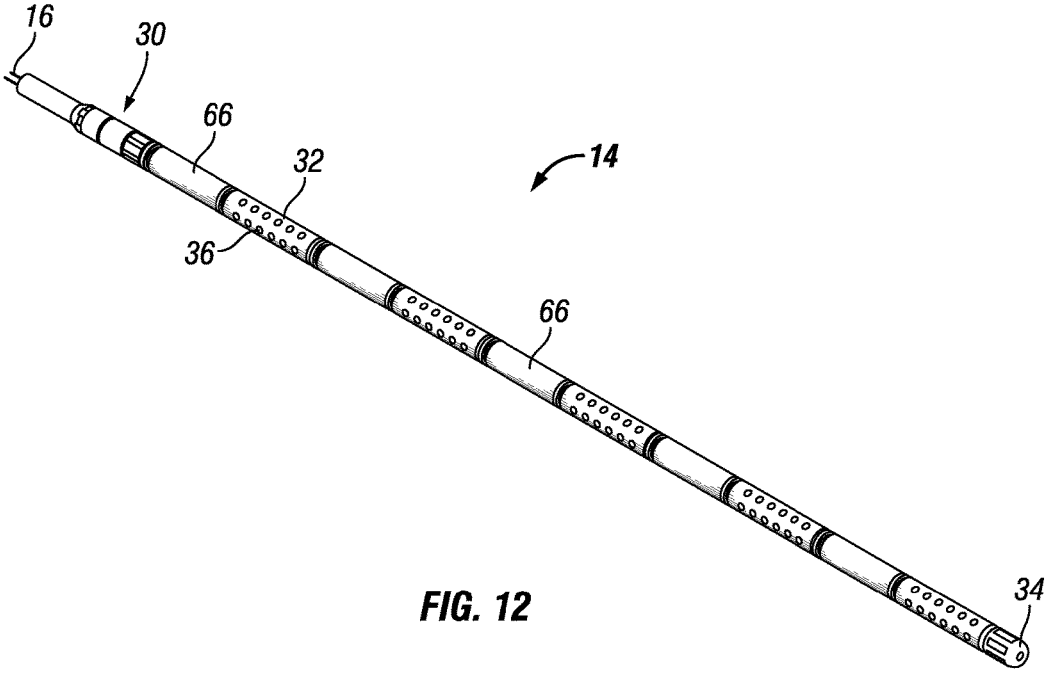
FIG. 12 is an example of FIG. 11 with multiple bodies attached.

FIG. 12 illustrates an example of a plurality of bodies 32 attached to each other and connected to supply line 16 through connection housing 30. Bodies 32 may be used to ignite and/or re-ignite underground energy source 4. Each body 32 may be ignited separately or at the same time. Extension 66 may connect bodies 32 to each other and/or connection housing 30. A plurality of bodies 32 may allow for the re-ignition of underground energy source 4 at an operators discretion. Body 32, cap 34, and/or plugs 36 may further comprise downhole ignition device 14. After the initial ignition of underground energy source 4 using a body 32, downhole ignition device 14 may be positioned away from the burning underground energy source 4. If re-ignition is needed, downhole ignition device 14 may be reinserted into the underground energy source 4 and a separate body 32 may be used to re-ignite underground energy source 4. The configuration illustrated in FIG. 4 may allow for an initial ignition of underground energy source 4 and re-ignitions of underground energy source 4 the number of bodies 32 within downhole ignition device 14.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole ignition device comprising:
- a connection housing, wherein the connection housing comprises an igniter and a first fire mix; and
- a body coupled to the connection housing, wherein the body comprises:
  - a plurality of sleeves, wherein a plurality of holes are disposed through the plurality of sleeves;
  - a plurality of pyrotechnic modules, wherein the plurality of pyrotechnic modules are disposed within and held in place by the plurality of sleeves, wherein each one of the plurality of pyrotechnic modules comprises:
    - a main load;
    - a channel, wherein the channel is disposed axially through the main load; and
    - pellets, wherein the pellets are disposed radially around the channel and extend from the channel into the main load; wherein the plurality of pyrotechnic modules produce an exothermic reaction to ignite an underground energy source into which a wellbore is drilled; and
- additional first fire mix.

2. The downhole ignition device of claim 1, wherein the body further comprises plugs that fill the plurality of holes in the body, wherein the pellets in the plurality of pyrotechnic modules are configured to burn through the plugs, wherein the plugs comprise a eutectic material.

3. The downhole ignition device of claim 1, wherein the downhole ignition device further comprises a cap disposed at an end of the downhole ignition device opposite the connection housing.

4. The downhole ignition device of claim 1, wherein the plurality of pyrotechnic modules are arranged in series, wherein the pellets extend into the main load.

5. The downhole ignition device of claim 1, wherein the connection housing further comprises an injection port for supplying an accelerant to the downhole ignition device.

6. The downhole ignition device of claim 1, wherein the body connects to a second body, wherein the second body comprises additional pyrotechnic modules arranged in series.

7. An underground gasification system, comprising:
- a downhole ignition device comprising:
  - a connection housing, wherein the, connection housing comprises an igniter and a first fire mix; and
  - a body coupled to the connection housing, wherein the body comprises:
    - a plurality of sleeves, wherein a plurality of holes are disposed through the plurality of sleeves;
    - a plurality of pyrotechnic modules, wherein the plurality of pyrotechnic modules are disposed within and held in place by the plurality of sleeves, wherein each one of the plurality of pyrotechnic modules comprises:
      - a main load;
      - a channel, wherein the channel is disposed axially through the main load; and
      - pellets, wherein the pellets are disposed radially around the channel and extend from the channel into the main load; wherein the plurality of pyrotechnic modules produce an exothermic reaction to ignite an underground energy source into which a wellbore is drilled; and
  - additional first fire mix; and
- a supply line for positioning the downhole ignition device adjacent the underground energy source.

8. The underground gasification system of claim 7, wherein the plurality of pyrotechnic modules are arranged in series, wherein the pellets extend into the main load.

9. The underground gasification system of claim 8, further comprising a cap disposed at an end of the downhole ignition device opposite the connection housing.

10. The underground gasification system of claim 9, wherein the body further comprises plugs that fill the plurality of holes in the body, wherein the pellets are configured to burn through the plugs.

11. The underground gasification system of claim 7, wherein the connection housing further comprises an injection port for supplying an accelerant to the downhole ignition device.

12. The underground gasification system of claim 11, wherein the body connects to a second body, wherein the second body comprises additional pyrotechnic modules arranged in series.

13. The underground gasification system of claim 7, further comprising an injection well and a recovery well are connected with the underground energy source, wherein the supply line extends through the injection well to position the downhole ignition device adjacent to the underground energy source.

14. A method for igniting an underground energy source, comprising:

positioning a downhole ignition device in a wellbore adjacent an underground energy source, wherein the wellbore is drilled into the underground energy source;

igniting a first fire mix in the downhole ignition device; and igniting a plurality of pyrotechnic modules arranged in the downhole ignition device with the first fire mix such that the underground energy source is ignited to produce synthetic gas, wherein each one of the plurality of pyrotechnic modules comprises:

a main load;

a channel, wherein the channel is disposed axially through the main load; and pellets, wherein the pellets are disposed radially around the channel and extend from the channel into the main load.

15. The method of claim 14, wherein the downhole ignition device comprises:

a connection housing at a first end of the downhole ignition device, wherein the connection housing comprises an igniter and a first fire mix;

a body coupled to the connection housing, wherein the body comprises the plurality of pyrotechnic modules arranged in series and additional first fire mix; and a cap disposed at a second end of the connection housing.

16. The method of claim 15, wherein the first fire mix is disposed within a pyrotechnic module and wherein the first fire mix and the pyrotechnic module traverses the length of the body.

17. The method of claim 15, further comprising transmitting accelerant to the downhole injection device through one or more injection ports in the connection housing.

18. The method of claim 15, wherein the first fire mix is disposed partially in the body.

19. The method of claim 14, further comprising:

withdrawing the downhole ignition device from the underground energy source and the wellbore with a recovery system;

positioning a second downhole ignition device adjacent the underground energy source in the wellbore; and igniting the second downhole ignition device.

* * * * *